US010876319B2

(12) United States Patent
Moeggenberg

(10) Patent No.: US 10,876,319 B2
(45) Date of Patent: Dec. 29, 2020

(54) ROOF SHADE APPARATUS

(71) Applicant: Howard R. Moeggenberg, Alma, MI (US)

(72) Inventor: Howard R. Moeggenberg, Alma, MI (US)

( * ) Notice: Subject to any disclaimer, the term of this patent is extended or adjusted under 35 U.S.C. 154(b) by 0 days.

(21) Appl. No.: 16/787,612

(22) Filed: Feb. 11, 2020

(65) Prior Publication Data

US 2020/0256082 A1 Aug. 13, 2020

Related U.S. Application Data

(60) Provisional application No. 62/804,205, filed on Feb. 11, 2019.

(51) Int. Cl.

| | |
|---|---|
| ***E04H 15/02*** | (2006.01) |
| ***E04G 21/24*** | (2006.01) |
| ***E04G 21/28*** | (2006.01) |
| ***E04H 15/60*** | (2006.01) |
| ***E04H 15/54*** | (2006.01) |
| ***E04H 15/64*** | (2006.01) |

(52) U.S. Cl.

CPC ..... *E04H 15/02* (2013.01); *E04G 21/28* (2013.01); *E04H 15/54* (2013.01); *E04H 15/60* (2013.01); *E04H 15/64* (2013.01); *E04G 2021/248* (2013.01); *Y10S 135/90* (2013.01); *Y10S 135/905* (2013.01)

(58) Field of Classification Search

CPC ..... E04H 15/34; E04H 15/44; E04H 15/54; E04H 15/60; E04H 15/64; E04H 15/646; E04G 21/28; E04G 2021/248

USPC ..... 135/88.07, 88.14, 114, 115, 119, 900; 248/121, 122.1, 218.4, 158, 418, 371, 248/398; 182/45, 107

See application file for complete search history.

(56) References Cited

U.S. PATENT DOCUMENTS

| | | | | | |
|---|---|---|---|---|---|
| 1,255,692 | A * | 2/1918 | Bearden | E04G 3/26 | 248/237 |
| 1,639,352 | A * | 8/1927 | Schade | E04G 3/26 | 248/237 |
| 1,646,923 | A * | 10/1927 | Martens | E04G 3/26 | 248/237 |
| 2,385,716 | A * | 9/1945 | Mahaffey | E04H 15/322 | 135/120.4 |
| 3,333,802 | A * | 8/1967 | Goodman | H01Q 1/1221 | 248/539 |
| 3,870,061 | A * | 3/1975 | Lowery | E04H 15/06 | 135/88.07 |
| 4,020,921 | A * | 5/1977 | Rawlings | E04G 3/26 | 182/45 |
| 4,946,123 | A * | 8/1990 | Albert | E04G 5/041 | 248/237 |
| 5,113,971 | A * | 5/1992 | Violet | E04G 5/041 | 182/45 |

(Continued)

*Primary Examiner* — Robert Canfield

(74) *Attorney, Agent, or Firm* — Corbett & Kreisher PLLC

(57) ABSTRACT

A support assembly for a rooftop shade system is provided. The support assembly includes a plate defining a plurality of parallel, angled slots that extend inward from one edge of the plate. The support assembly also includes a pole that is operatively connected to the plate such that the angle formed between the plate and the pole is selectively variable. The pole terminates at a pin that is insertable through a grommet on a tarp to thereby support the tarp.

7 Claims, 4 Drawing Sheets

(56) References Cited

U.S. PATENT DOCUMENTS

| | | | | |
|---|---|---|---|---|
| 5,799,680 | A * | 9/1998 | Dorflinger | E04G 5/12 135/116 |
| 6,857,504 | B1 * | 2/2005 | Branter | E04G 3/26 182/113 |
| 7,150,306 | B2 * | 12/2006 | Ghazali | B60J 11/00 160/370.21 |
| 7,546,844 | B2 * | 6/2009 | Al-Mutairi | E04H 6/025 135/143 |
| 9,010,348 | B1 * | 4/2015 | Kite | E04H 6/04 135/88.06 |
| 9,506,268 | B1 * | 11/2016 | Bright | E04H 15/58 |
| 9,797,154 | B1 * | 10/2017 | McKinney | E04H 15/02 |
| 9,926,715 | B1 * | 3/2018 | Morrison | E04H 6/04 |
| 2002/0109060 | A1 * | 8/2002 | Macri | E04G 3/26 248/237 |
| 2004/0051017 | A1 * | 3/2004 | Mislich | E04G 3/26 248/237 |
| 2006/0185706 | A1 * | 8/2006 | Slade | E04H 15/44 135/122 |
| 2008/0302934 | A1 * | 12/2008 | Nelson | E04G 3/26 248/237 |
| 2012/0067667 | A1 * | 3/2012 | Marcoux | E04G 21/3276 182/3 |
| 2019/0242153 | A1 * | 8/2019 | MacKarvich | E04H 15/64 |

* cited by examiner

ROOF SHADE APPARATUS

CROSS-REFERENCE TO RELATED APPLICATION

This application claims the benefit of U.S. Provisional Application No. 62/804,205, filed Feb. 11, 2019, and which is hereby incorporated by reference in its entirety.

TECHNICAL FIELD

This disclosure relates to apparatuses that provide temporary shade and covering over roofs.

BACKGROUND

The roof of a building, such as a house, is exposed to extreme conditions, which renders working on a roof difficult. Snow and ice often cover roofs in winter, so repairs and maintenance often must be done in the summer. However, the temperature and sun exposure on a roof in summer or other warm periods is very uncomfortable.

SUMMARY

A support assembly for a rooftop shade system is provided. The support assembly includes a plate defining a plurality of parallel, angled slots that extend inward from one edge of the plate. The support assembly also includes a pole that is operatively connected to the plate such that the angle formed between the plate and the pole is selectively variable. The pole terminates at a pin that is insertable through a grommet on a tarp to thereby support the tarp.

The plate with parallel angled slots enables the support assembly to be temporarily mounted to a roof, such as during repair or maintenance of the roof, without resulting in permanent damage to the roof; nails used to secure shingles to the roof may be driven through the slots to retain the assembly to the roof. The pin provides a more compact connection between the support assembly and the tarp compared to the prior art.

A corresponding method is also provided.

The above features and advantages and other features and advantages of the present disclosure are readily apparent from the following detailed description of the best modes for carrying out the disclosure when taken in connection with the accompanying drawings

DESCRIPTION OF THE PREFERRED EMBODIMENTS

Figure 3:
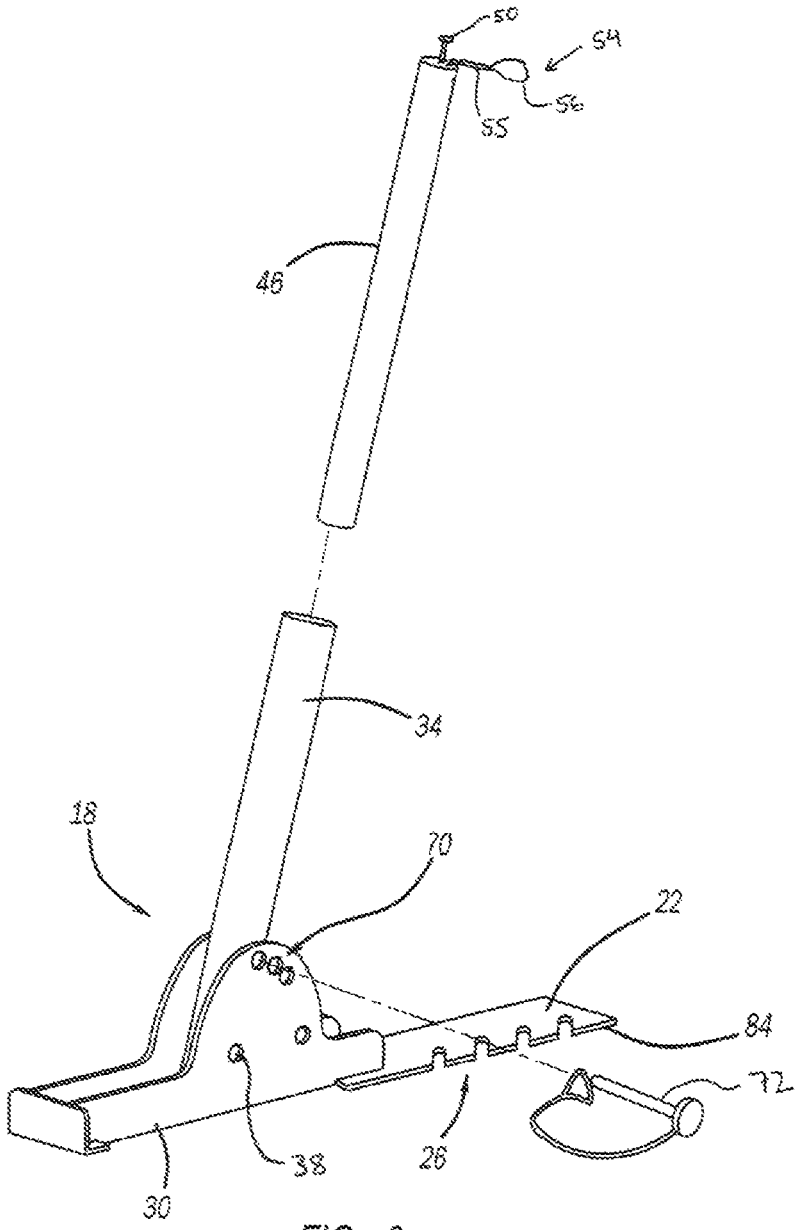
FIG. 3 is a schematic, perspective view of a support assembly of the shade assembly.
Figure 4:
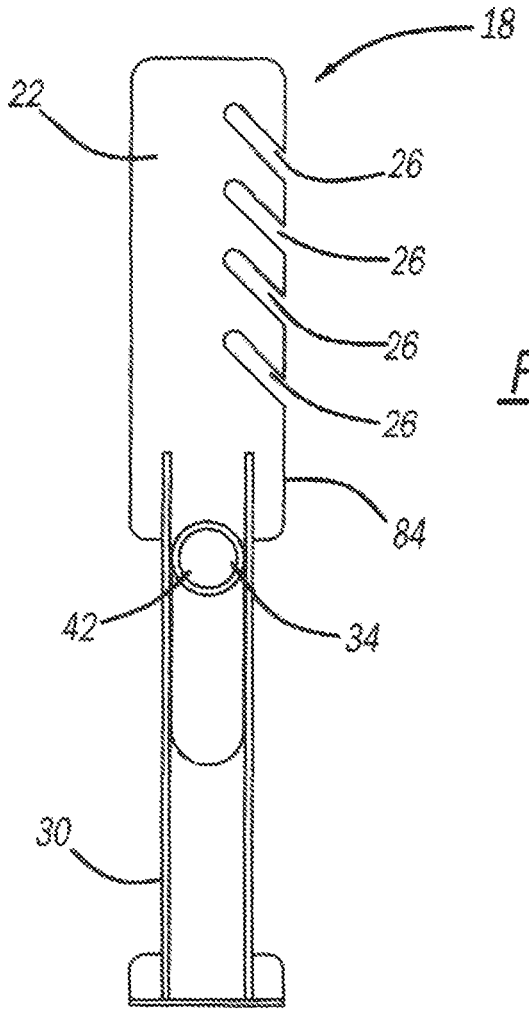
FIG. 4 is a schematic, top view of the support assembly.

Referring to the Figures, wherein like reference numbers refer to like components throughout, a rooftop shade assembly 10 is schematically depicted. The shade assembly 10 is mounted to a roof 14, such as the roof of a house. The assembly 10 includes a plurality of tarp support assemblies 18. Each assembly 18 includes a respective flat plate 22 that defines a plurality of parallel, angled slots 26. Each assembly 18 also includes a respective bracket 30 mounted to a corresponding plate 22. Each assembly 18 also includes a respective tube 34 that is rotatably mounted to the plate 22 via the bracket 30 and a pivot pin (shown at 38 in FIG. 3). The tube 34 defines a cylindrical cavity 42.

The assembly 10 includes a plurality of poles 46. The outer diameter of each pole 46 is slightly smaller than the diameter of the cylindrical cavities 42 in each of the tubes 34. Each pole 46 is inserted into the cavity 34 of a respective one of the tubes 34. Each pole 46 has a respective pin 50 mounted at its upper end (i.e., opposite the tube 34) and a respective bungee lock 54.

Figure 5:
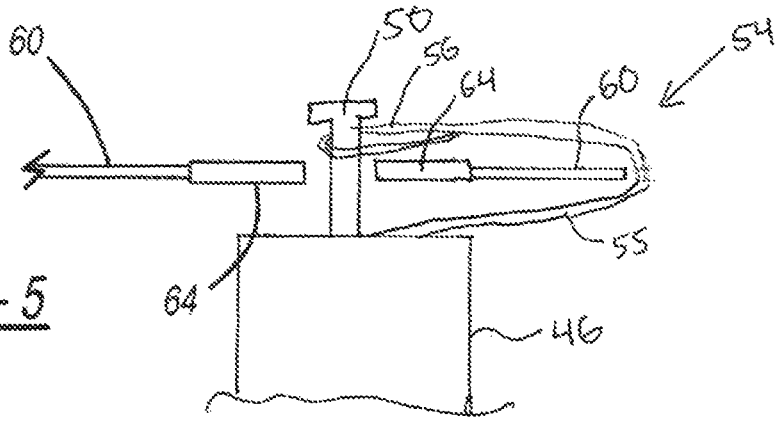
FIG. 5 is a schematic, sectional, side view of the connection between the support assembly and a tarp.

The poles 46 support a tarp 60 above the roof 14. The tarp 60 has a plurality of grommets 64 through which a respective pin 50 extends and is retained by one of the bungee locks 54. More specifically, a bungee lock 54 includes an elastic cord 55 formed in the shape of a loop 56 and that is mounted to the pole 46. To secure the tarp 60 to the assembly 18, the cord 55 is elastically stretched around the edge of the tarp 60 and moved until the pin 64 extends through the loop 56, as shown in FIG. 5. Although bungee locks 54 are employed in the embodiment depicted, other locking systems may be employed to prevent removal of the pins 50 from the grommets 64 within the scope of the claimed invention. It should also be noted that the pin 64 may be integrally formed with the pole 46, or may be a separate piece attached to the pole 46. The tarp 60 provides shade on the roof 14, thereby facilitating work and maintenance on the roof 14, improving safety and comfort for workers.

Figure 1:
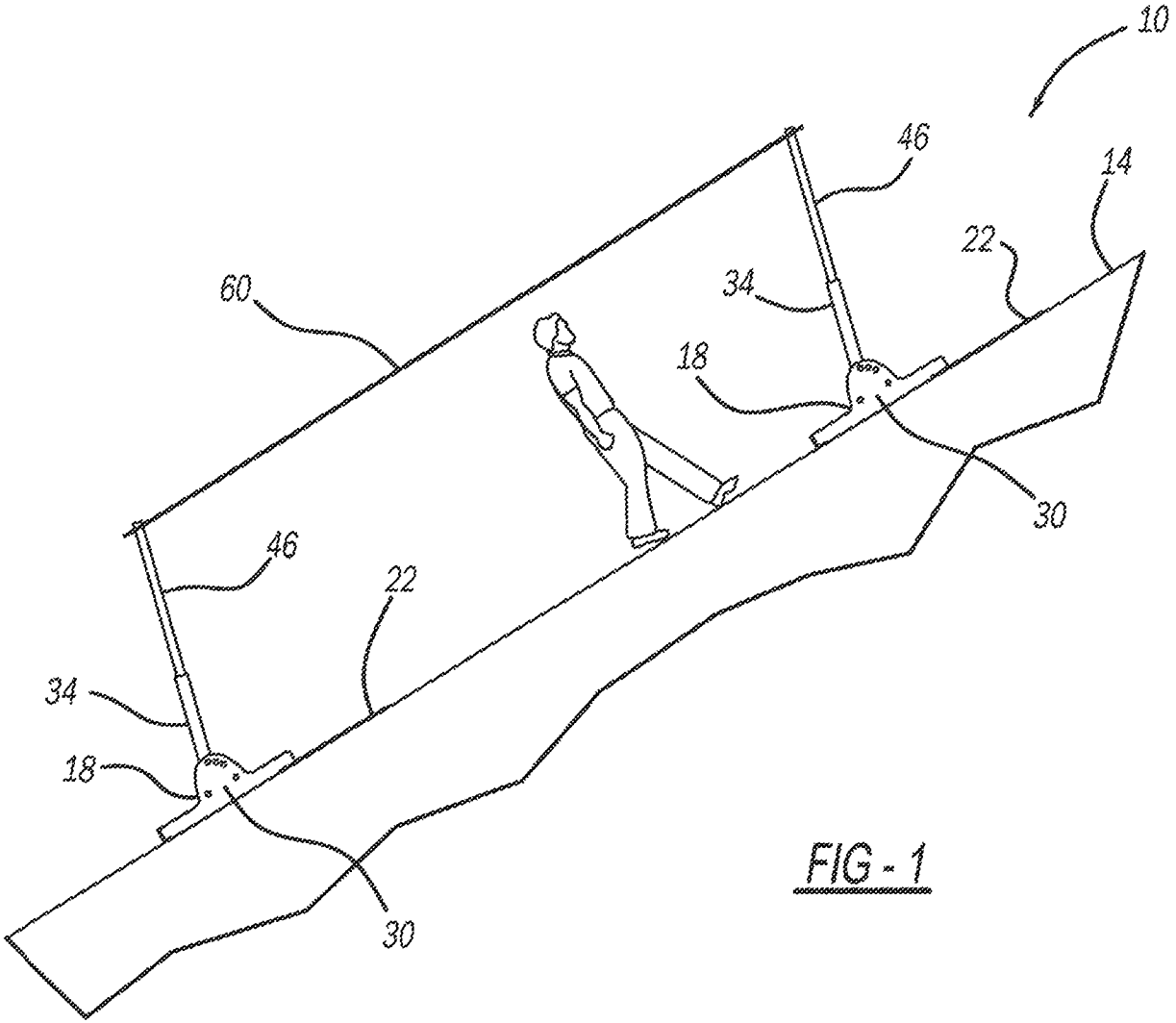
FIG. 1 is a schematic side view of a rooftop shade assembly on a roof.
Figure 2:
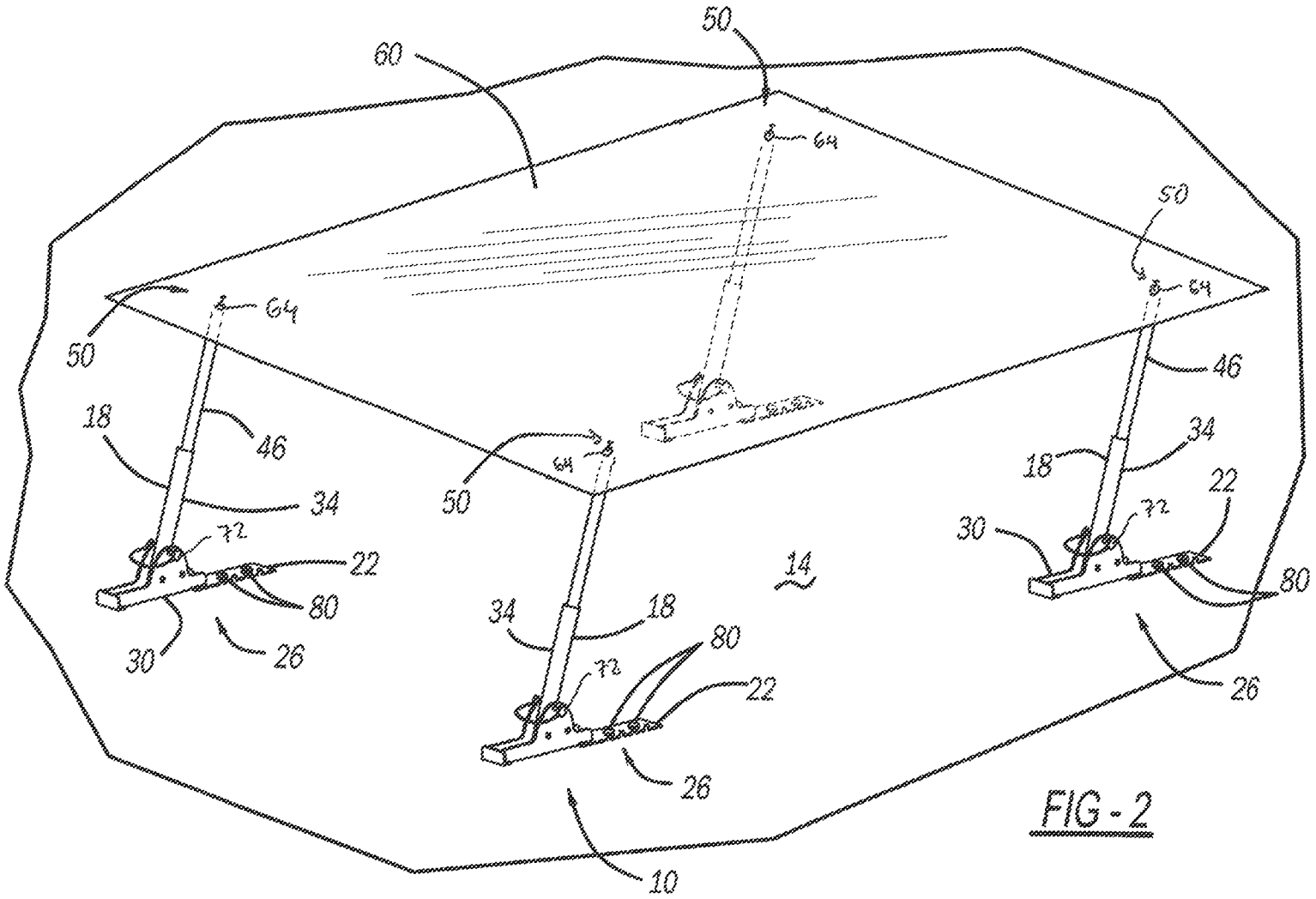
FIG. 2 is a schematic, perspective view of the rooftop shade assembly.

In the embodiment depicted in FIG. 1, the tarp 60 is substantially parallel to the roof 14. The tubes 46 are rotatable with respect to the plates 22 to accommodate the slopes of different roofs, i.e., to make the tarp 60, supported by the poles 46, substantially parallel to the roof 14. A locking feature secures the tubes 34 with respect to the plates 22 at the desired angle, e.g., vertical. For example, the brackets 30 may define a plurality of holes 70 through which a pin 72 can be inserted to lock the tube 34 at a desired angle with respect to the bracket 30 and, correspondingly, the roof 14.

The plates 22 are secured to the roof 14 via nails 80 that extend into the roof 14 through the slots 26. The nails 80 may also secure shingles to the roof 14. The assembly 10 is removed by simply sliding the plate 22 so that the nails exit the slots 26. The slots 26 extend from the edge 84 of the plate 22 at an angle of approximately 45 degrees.

A method of using the assembly 10 includes mounting a plurality of the support assemblies 18 to a roof 14 by causing nails 80 to extend through at least one of the slots 26 on each of the support assemblies 18. The method may also include inserting a respective pole 46 into each of the cavities 42 of the support assemblies 18.

While the best modes for carrying out the invention have been described in detail, those familiar with the art to which this invention relates will recognize various alternative designs and embodiments for practicing the invention within the scope of the appended claims.

The invention claimed is:

1. A support assembly comprising:

a plate defining a plurality of parallel angled slots that extend inward from one edge of the plate;

a pole that is operatively connected to the plate such that the angle formed between the plate and the pole is selectively variable;

a pin at a terminal end of the pole.

2. The support assembly of claim 1, further comprising a tube being rotatably mounted with respect to the plate;

wherein the pole extends into the tube.

3. A rooftop assembly comprising:

a plurality of tarp support assemblies, each of the tarp support assemblies comprising a respective plate defining a plurality of parallel and angled slots and a respective tube rotatably connected to a corresponding plate;

said tarp support assemblies being secured to the rooftop by at least one nail inserted through at least one of the angled slots;

a plurality of poles, each being telescopingly fitted into a respective one of the tubes and having a respective pin;

a tarp defining a plurality of holes; each of said pins extending through a respective one of the holes.

4. A method comprising:

possessing a support assembly having a plate defining a plurality of angled slots;

attaching the plate to the roof be extending a nail through at least one of the slots;

supporting a tarp above the roof with the support assembly.

5. The method of claim 4, wherein the support assembly includes a pole with a pin at the end; and wherein said supporting a tarp above the roof includes extending the pin through a hole in the tarp.

6. The method of claim 5, wherein the hole is defined by a grommet.

7. The method of claim 5, further comprising rotating the pole with respect to the plate.

* * * * *